United States Patent [19]

McCullough, Jr. et al.

[11] Patent Number: 4,950,540

[45] Date of Patent: Aug. 21, 1990

[54] METHOD OF IMPROVING THE FLAME RETARDING AND FIRE BLOCKING CHARACTERISTICS OF A FIBER TOW OR YARN

[75] Inventors: Francis P. McCullough, Jr., Lake Jackson; R. Vernon Snelgrove, Damon; Frank W. Hale, Lake Jackson, all of Tex.; David M. Hall, Auburn, Ala.

[73] Assignee: The Dow Chemical Company, Midland, Mich.

[21] Appl. No.: 378,727

[22] Filed: Jul. 11, 1989

Related U.S. Application Data

[62] Division of Ser. No. 114,324, Oct. 28, 1987, Pat. No. 4,879,168.

[51] Int. Cl.[5] ..... D02G 3/00

[52] U.S. Cl. ..... 428/369; 428/357; 428/362; 428/364; 428/367; 428/361; 428/373; 428/408

[58] Field of Search ..... 428/367, 408, 373

[56] References Cited

U.S. PATENT DOCUMENTS

| | | | |
|---|---|---|---|
| 3,573,961 | 4/1971 | Hawkins et al. | 428/367 X |
| 3,778,334 | 12/1973 | Sturgeon | 428/367 X |
| 3,904,577 | 9/1975 | Buisson | 428/367 X |
| 4,256,801 | 3/1981 | Chuluda . | |
| 4,444,574 | 4/1984 | Tradewell et al. | 428/367 X |
| 4,457,345 | 7/1984 | von Blucher et al. | 57/252 X |
| 4,460,650 | 7/1984 | Ogawa et al. | 428/389 |
| 4,539,249 | 9/1985 | Curzio . | |
| 4,643,931 | 2/1987 | McCullough, Jr. et al. | 428/367 X |
| 4,698,956 | 10/1987 | Clarke et al. | 57/350 |

FOREIGN PATENT DOCUMENTS

WO86/06110 10/1986 PCT Int'l Appl. .

*Primary Examiner*—Lorraine T. Kendell

[57] ABSTRACT

Flame retarding and fire barrier structure comprising a blend of carbonaceous fibers and natural and/or synthetic fibers. The carbonaceous fibers have a nitrogen content of 5 to 35%, an LOI value of greater than 40 and are derived from stabilized acrylic fibers.

7 Claims, No Drawings

METHOD OF IMPROVING THE FLAME RETARDING AND FIRE BLOCKING CHARACTERISTICS OF A FIBER TOW OR YARN

CROSS REFERENCE TO RELATED APPLICATION

This is a divisional of application Ser. No. 114,324, filed Oct. 28, 1987, now U.S. Pat. No. 4,879,168.

FIELD OF THE INVENTION

The present invention relates to flame retarding and fire barrier structures and fabrics. More particularly, the invention is concerned with structures and fabrics comprising a blend of carbonaceous fibers with synthetic and/or natural fibers, and a method for using said structures.

BACKGROUND OF THE INVENTION

The prior art has used asbestos, carbon and graphite short straight staple felts, and various ceramic materials, particularly ceramic foams as thermal insulation having fire blocking properties. The bulk densities of some of the well known thermal insulating materials are in the range of 0.35 to 2 pounds per cubic foot (5.6–32.04 kg/m$^3$) for insulating materials useful at temperatures not exceeding 120° C., and from 2 to 5 pounds per cubic foot (32 to 80 kg/m$^3$) for the high temperature (about 3000° F.) insulating materials. Even the newest "light weight" insulating material recently disclosed comprising a ceramic from which a carbonaceous material has been burned out has a bulk density of about 2 to 6 pounds per cubic foot (32 to 96 kg/m$^3$). In addition, with the possible exception of fiberglass which may be used under certain conditions as a fire block, the common thermal insulating materials having fire block properties, such as carbon or graphite felts and ceramic materials, do not have any resiliency, i.e., they do not have the abilitity to recover from compression of the original "loft". Further, these prior art materials are not compressible from their original loft to any great degree since substantially straight or linear fibers do not have substantial distance between the fibers, thus there is very little loft between the linear fibers and therefore substantially no compressibility.

Both government and industry have conducted extensive research into developing fabrics that would either by non-flammable or at least retard the propagation of a fire. In conjunction with finding an effective material to act as a fire barrier, consumer considerations require that any such materials to be functional, aesthetically acceptable and reasonably priced.

Unfortunately, past efforts to develop a suitable fire barrier have not been very effective. Thus, even fabrics that will not ignite from a smoldering cigarette and that are considered to be class 1 fabrics under the UFAC upholstery fabric classification test will burn when placed in contact with an open flame. Consequently, this leads to the ignition of an underlying batting in a cushion or mattress.

So-called fire retardant foam coatings for draperies, liners and backcoatings for upholstery, as well as chemical treatments for apparel fabrics that attempt to provide a fire retardant quality to the fabric are commercially available. Unfortunately, these materials are, at best, self extinguishing only when the source of the flame is removed. If the flame source is not removed, these materials will char, lose their integrity and, most importantly, will not prevent the flame from reaching materials underneath the fabric covering which act as a major source of fuel for the fire.

Other attempts at solving the flammability problem have centered on the use of inherently non-flammable fabrics such as fiberglass which can be used, for example in draperies. It has been discovered, however, that the glass fibers are self abrasive in that they rub against each other thereby becoming self-destructing due to the abrasive action. Thus, hand washing and line drying is, out of necessity, the recommended cleaning procedure for such fabrics. Moreover, the brittle and broken glass fibers tend to be very irritating to the skin thus rendering any of the applications of the fabric unsuitable where there is extensive skin contact. Fiberglass fabrics usually contain flammable sizing binders and/or finishes to provide an aesthetic appearance.

Consequently, there is a need for fabrics, battings and the like which not only provide fire shielding properties but also are washable, light weight and can be fabricated into aesthetically acceptable fabrics for home and commercial use.

U.S. Pat. No. 4,588,635 to James. G. Donovan discloses light weight thermal insulation material which is a blend of spun and drawn, crimped, staple, synthetic polymer microfibers having a diameter of from 3 to 12 microns, and synthetic polymeric staple microfibers having a diameter of more than 12 and up to 50 microns. However, the insulation material is flammable.

U.S. Pat. No. 4,167,604 to William E. Aldrich discloses the use of crimped hollow polyester filaments in a blend with fowl down in the form of a multiple ply carded web which is treated with a thermosetting resin to form a batting having termal insulating characteristics. The web, however, does not have fire retarding characteristics.

U.S. Pat. No. 4,321,154 to Francois Ledru relates to high temperature thermal insulation material comprising insulating material fibers and pyrolytic carbon. To make the insulation light weight, an expanding agent is utilized that is composed of hollow particles such as microshperes.

European Patent Application 0199567 of McCullough, et al discloses non-linear carbonaceous fibers which are used in the structures and fabrics of the present invention.

The carbonaceous fibers of the invention according to the test method of ASTM D 2863-77 have a LOI value greater than 40. The test method is also known as "oxygen index" or "limited oxygen index" (LOI). With this procedure the concentration of oxygen in $O_2/N_2$ mixtures is determined at which a vertically mounted specimen is ignited at its upper end and just continues to burn. The size of the specimen is 0.65×0.3 cm with a length from 7 to 15 cm. The LOI value is calculated according to the equation:

$$LOI = \frac{[O_2]}{[O_2 + N_2]} \times 100$$

The LOI values of different fibers are as follows:

| | |
|---|---|
| polypropylene | 17.4 |
| polyethylene | 17.4 |
| polystyrene | 18.1 |
| rayon | 18.6 |
| cotton | 20.1 |

-continued

| | |
|---|---|
| nylon | 20.0 |
| polycarbonate | 22 |
| rigid polyvinyl chloride | 40 |
| stabilized polyacrylonitrile | greater than 40 |
| graphite | 55 |

The term "stabilized" herein applies to fibers or tows which have been oxidized at a specific temperature, typically less than about 250° C. for PAN fibers, provided it is understood that in some instances the filaments or fibers are oxidized by chemical oxidants at lower temperatures.

The term "Reversible Deflection" as used herein applies to a helical or sinusoidal compression spring. Particular reference is made to the publication "Mechanical Design-Theory and Practice", MacMillan Publ. Co., 1975, pp 719 to 748; particularly Section 14-2, pages 721–24.

SUMMARY OF THE INVENTION

In accordance with the present invention there is provided flame retarding and flame shielding or blocking structures comprising at least about 7.5% by weight of linear and/or non-linear carbonaceous fibers having a carbon content of at least 65%, derived from heat set stabilized acrylic fibers or a pitch based fiber. The structure comprises synthetic and/or natural fibers in an intimate blend with the carbonaceous fibers. Advantageously, the carbonaceous fibers of the structures comprise non-flammable non-linear carbonaceous filaments having a reversible deflection ratio of greater than 1.2:1, preferably greater than 2.0:1, and an aspect ratio (l/d) greater than 10:1. The non-linear fibers have been found to provide considerable loft and improved thermal insulating properties to structures and/or fabrics utilizing them. The non-linear fibers also provides a porosity which inhibits the spread of fire. Both linear and non-linear carbonaceous fibers have a LOI value greater than 40.

Furthermore, it has been surprisingly found that the carbonaceous fibers when intimately blended in an amount of at least 7.5% together with, synthetic and/or natural fibers into a structure, such as a batting, fabric, tow or the like, results in a synergistic effect with respect to fire blocking and fire retarding properties to the blend. It is understood that when the structure is densified for a particular use, it is preferable to use a higher amount of carbonaceous fibers.

The invention further contemplates a method for providing flame retarding and fire shielding structures with respect to a structural part or a pair of adjacent structural parts.

It is therefore an object of the invention to provide a structure such as a tow, fabric or batting which is both fire retarding and provides a fire barrier.

It is another object of the invention to provide a fire shielding structure comprising an intimate blend of carbonaceous fibers with other synthetic and/or natural fibers which possesses good handling and washing characteristics.

It is yet another object of the invention to provide a method for forming a fire shield for a structural part or a pair of adjacent structural parts.

It is still a further object of the invention to provide a fabric which is aesthetically acceptable and possesses fire blocking characteristics.

DETAILED DESCRIPTION OF THE INVENTION

In accordance with the invention, it has been surprisingly discovered that a fibrous structure comprising at least 7.5% of heat set carbonaceous fibers having an LOI value of greater than 40 and which are derived from an acrylic fiber or a pitch based fiber, when intimately blended with natural and/or synthetic fibers provides a synergistic improvement in the fire retarding and fire blocking characteristics of the resulting composition. Even more significant results are achieved when the carbonaceous fibers are non-linear fibers, have a reversible deflection ratio of greater than 1.2:1 and an aspect ratio (l/d) greater than 10:1. Both the linear and non-linear fibers can be utilized in connection with the present invention. When the carbonaceous fibers are non-linear the loft and the reforming characteristics of the structure, fabric or tow, which contains the blend of fibers, is maintained even after long periods of compression. It is understood that the greater the amount of non-linear carbonaceous fibers which are utilized, the better will be the reforming and fire retarding characteristics of the structure. Preferably, when only linear carbonaceous fibers are being utilized, they are present in the blend in an amount of at least 17%.

The natural or other synthetic fibers may also be linear or non-linear. However, the non-linear carbonaceous fibers of the invention are substantially permanently non-linearly set so that the structure permanently maintains a degree of loft and porosity to provide good hand even when the other fibers lose their non-linearity.

The non-linear carbonaceous fibers which are utilized may have a sinusoidal and/or a coil-like configuration depending upon the ultimate use of the fibers. The acrylic derived fibers have a nitrogen content between 5 and 35%, preferably from 18 to 25%. The terpolymers with acrylic units may contain the higher nitrogen content.

In accordance with one embodiment of the invention, the carbonaceous fibers are opened and is then blended with either synthetic fiber or natural fiber or both to form a mixture. Although the relative amounts of carbonaceous fibers and other fibers may be varied over substantially broad limits, it has been found that at least 7.5% carbonaceous fibers, preferably non-linear fibers, must be employed in order to achieve the flame retarding characteristics of the material of the invention. Preferably, 7.5% of the carbonaceous fiber is used in a batting having a density of 0.4 to 0.6 lb/ft$^3$ (6.4 to 9.6 kg/m$^3$).

The blend of carbonaceous fibers and other fibers may be then formed into a carded web employing conventional carding equipment which is well known to persons of ordinary skill in the art. The carding operation serves to uniformly blend the carbonaceous fibers and other staple fibers. The carded web will ordinarily have a thickness in the range of up to 2 inches (5.0 cm), but may be built-up in multiple plies to produce a web having a thickness of one inch or more depending upon the desired end use of the material.

The blend of fibers may be utilized in order to form fabrics having fire retarding characteristics. For example, a blend of fibers which contains from 7.5 to about 20% of the carbonaceous fibers of the invention may be utilized to manufacture fire retardant articles such as clothing, blankets, sheets, and the like because of the excellent washability and shape retaining quality especially when a large portion (about 30–50%) of non-linear fibers are employed. Carbonaceous fibers in which the nitrogen content is between 18 and 20% are especially useful for fabrics making skin contact with the wearer.

Fabric structures which contain the carbonaceous fibers of the invention in amounts from about 20 to about 40% may advantageously be used for seat coverings in aircrafts upholstery, battings in seat covers, curtains and the like.

Use of greater amounts of carbonaceous fibers in the blends improves the fire blocking and fire shielding characteristics of the structures. The structures having greater amounts of carbonaceous fibers also have greater chemical resistance. The structures may be used as fiber filters, hose coverings, static precipitators and the like. However, it is desirable to try to maintain a fabric characteristic close to conventional structures so as to have an aesthetic appearance and feel.

The fabrics may comprise a blend of all natural, all synthetic or a combinatino of both together with the carbonaceous fibers.

The natural fibers wherein the synergistic effect is found when used in a blend with the carbonaceous fibers of the invention include cotton, wool, flax and silk.

The synthetic fibers which can be utilized to form a blend with the carbonaceous fibers of the present invention include polyolefins, for example polyethylene, polypropylene and the like, polyvinyl chloride, polyvinyl alcohol, polyesters, polyacrylonitrile, polyacrylates, polycarbonate, cellulosic products, ionomers, DACRON (Trademark), KEVLAR (Trademark), and the like. It is to be understood of course, that a blend of natural and/or synthetic fibers with the carbonaceous fibers may be used.

The precursor stabilized acrylic filaments which are advantageously utilized in preparing the carbonaceous fibers of the invention are selected from the group consisting of acrylonitrile homopolymers, acrylonitrile copolymers and acrylonitrile terpolymers.

The copolymers and terpolymers preferably contain at least about 85 mole percent of acrylic units, preferably acrylonitrile units, and up to 15 mole percent of one or more monovinyl units copolymerized with styrene, methylacrylate, methyl methacrylate, vinyl chloride, vinylidene chloride, vinyl pyridene, and the like.

Preferred precursor materials are prepared by melt spinning or wet spinning the precursor materials in a known manner to yield a monofilament or multi-filament fiber tow. The fibers or filaments are formed into a yarn, woven cloth, fabric knitted cloth and the like by any of a number of commercially available techniques, heated, preferably to a temperature above about 525 degrees C in a non-oxidizing atmosphere and thereafter deknitting and carded to produce a wool-like fluff which may be laid up in batting-like form.

Exemplary of the products which can be structures of the present invention are set forth in the following examples. It is understood that the percentages referred to herein relate to percent by weight.

EXAMPLE I

A. Battings were made by blending an appropriate weight percent of each respective opened fiber in an blender/feed section of a sample size 12" Rando Webber Model B manufactured by Pando Machine Corp. of Macedon, N.Y. The battings produced typically were 1 inch (2.54 cm) thick and had bulk densities in a range of from 0.4 to 6 lb/cc ft (6.4 cm to 96 kg/cc $m^3$). The battings were thermally bonded by passing the Rando batting on a conveyor belt through a thermal bonding oven at a temperature of about 300° C.

Flammability tests were run in a standard apparatus as cited in FTM 5903 according to the procedure of FAR 35.853b which references FTM 5903. The results are shown in the following Table I:

TABLE I

| Sample No. | Sample Composition | % Wt. | Burn Length (in.) | After Flame (Sec.) | Flame Drop Time (sec.) | Pass or Fail |
|---|---|---|---|---|---|---|
| 1 | NCF/PEB/PE | 10/20/70 | 2/1/1 | 0/0/0 | 0/0/0 | passed |
| 2 | NCF/PEB/PE | 20/20/60 | .75/.75/.75 | 0/0/0 | 0/0/0 | passed |
| 3 | NCF/PEB/PE | 25/20/55 | .75/.75/.75 | 0/0/0 | 0/0/0 | passed |
| 4 | NCF/PEB/PE | 30/20/50 | .5/.5/.5 | 0/0/0 | 0/0/0 | passed |
| 5 | NCF/PEB/PE | 40/20/40 | <.5/<.5/0 | 0/0/0 | 0/0/0 | passed |
| 6 | NCF/PEB/PE | 5/20/75 | complete | >20 sec. | 0/0/0 | failed |
| 7 | NCF/PEB/PE | 50/20/30 | 0/0/0 | 0/0/0 | 0/0/0 | passed |
| 8 | OPF/PEB/PE | 10/20/70 | complete | >20 sec. | 0/0/0 | failed |
| 9 | LCF/PEB/PE | 50/20/30 | <.25/<.25/<.25 | 0/0/0 | 0/0/0 | passed |
| 10 | NCF/PEB/cotton | 10/10/80 | .5/.25/.5 | 0/0/0 | 0/0/0 | passed |
| 11 | Nomex TM /PEB/PE | 20/20/60 | complete | >38 sec. | 0/0/0 | failed |
| 12 | Nomex TM /PEB/PE | 50/20/30 | complete | >30 sec. | 0/0/0 | failed |
| 13 | NCF/PEB/Cotton | 10/15/75 | .75/.75/.5 | 0/0/0 | 0/0/0 | passed |
| 14 | NCF/PEB/Cotton | 5/15/80 | >12 | >14 | — | failed |
| 15 | NCF/PEB/PE | 5/20/75 | >12 | >195 | 0/0/0 | failed |
| 16 | NCF/PEB/PE | 7.5/20/72.5 | 2/10/2 | 0/7/0 | 0/0/0 | borderline |
| 17 | LFC/PEB/Cotton | 25/15/60 | 1/1.25/1 | 0/0/0 | 0/0/0 | passed |
| 18 | OPF/PEB/Cotton | 50/15/35 | >14 | 3 sec. | 0/0/0 | failed |
| 19 | NCF/PEB/Cotton | 20/15/65 | .75/.75/.75 | 0/0/0 | 0/0/0 | passed |
| 20 | NCF/PEB/Wool | 5/15/80 | >10 | >5 | 0/0/0 | failed |
| 21 | NCF/PEB/Wool | 10/15/75 | 1.25/1/1 | 0/0/0 | 0/0/0 | passed |
| 22 | NCF(sc)/PEB/Cotton | 20/15/65 | 1/1/.75 | 1.5/0 | 0/0/0 | passed |

TABLE I-continued

| Sample No. | Sample Composition | % Wt. | Burn Length (in.) | After Flame (Sec.) | Flame Drop Time (sec.) | Pass or Fail |
|---|---|---|---|---|---|---|
| 23 | OPF/PEB/PE | 50/20/30 | >12 | 8/8 | 0/0/0 | failed |

NCF = non-linear carbonaceous fiber
LCF = linear carbonaceous fiber
LCF(SC) = linear carbonaceous fiber with small amplitude crimp
PEB = 8 denier polyester binder fiber of 410 KODEL (Trademark)
PP = polypropylene
PE = 6 denier 2" staple Dupont DACRON (Trademark) 164 FOB polyester
Cotton = non-treated 1½" cotton
OPF = stablized polyacrylonitrile fiber
NOMEX = trademark of an aramid fiber available from E. I. du Pont & Co.

The above table shows surprisingly that use of as little as 7.5% by weight of carbonaceous fibers in the blends resulted in substantially no after flame when the flame source was removed and no flame drippings

EXAMPLE II

Following the procedure of Example I similar tests were performed and the results are shown in the following Table II.

TABLE II

| Sample No. | Sample Comp. | Composition | Densification Method | Burn Length (in) | After Flame (sec) | Flame Drop (sec) | Pass or Fail |
|---|---|---|---|---|---|---|---|
| 1 | NCF/PEB/PE | 30/20/51 | NP | 1.5/1.5/1 | 0/0/0 | 0/0/0 | passed |
| 2 | NCF/PEB/PE | 30/20/50 | PS | .5/.75.5 | 0/0/0 | 0/0/0 | passed |
| 3 | Nomex TM /PEB/PE | 20/20/60 | NP | total | 30 sec. | 2 sec. | failed |
| 4 | Nomex TM /PEB/PE | 50/20/30 | NP | total | 40 sec. | — | failed |
| 5 | NCF/PEB/PE | 20/20/60 | NP | 2/2/2 | 0/0/0 | 0/0/0 | passed |
| 6 | NCF/PEB/PE | 20/20/60 | PS | 1.5/1.5/1.5 | 0/0/0 | 0/0/0 | passed |
| 7 | NCF/PEB/Cotton | 30/15/55 | NP | 1/1/1 | 0/0/0 | 0/0/0 | passed |
| 8 | NCF/PEB/Cotton | 30/5/55 | — | .5/.5/.5 | 0/0/0 | 0/0/0 | passed |
| 9 | NCF/PEB/Cotton | 30/15/55 | NP | .75/.75/.75 | 0/0/0 | 0/0/0 | passed |
| 10 | NCF/PEB/Cotton | 30/15/15 | PS | 1.25/1.5/1.25 | 0/0/0 | 0/0/0 | passed |
| 11 | Kelvar TM /PEB/PE | 50/20/30 | — | .5/.5/.5 | 0/0/0 | 0/0/0 | passed |
| 12 | Kelvar TM /PEB/PE | 50/20/30 | NP | 3.5/3/3.5 | 0/0/0 | 0/0/0 | passed |
| 13 | Kelvar TM /PEB/PE | 50/20/30 | PS | 1.25/1.5/1.5 | 0/0/0 | 0/0/0 | passed |
| 14 | Kelvar TM /PEB/PE | 20/20/60 | — | >12 | complete burn | | failed |
| 15 | Kelvar TM /PEB/cotton | 50/15/35 | — | 15/.5/.5 | 0/0/0 | 0/0/0 | passed |
| 16 | Kelvar TM /PEB/cotton | 50/15/35 | NP | .5/.5/.5 | 0/0/0 | 0/0/0 | passed |
| 17 | Kelvar TM /PEB/cotton | 50/15/35 | PS | .75/.75/.75 | 0/0/0 | 0/0/0 | passed |

NP = needle punched at 100 punches/in$^2$
PS - Pin Sonic Thermally Bonded in diamond pattern

EXAMPLE III

Non-Flammability Test

The non-flammability of the fabric of the invention has been determined following the test procedure set forth in 14 CFR 25.853(b), which is herewith incorporated by reference. The test was performed as follows:

A minimum of three 1"×6"×12" (2.54 cm×15.24 cm×30.48 cm) specimens comprised of 10% carbonaceous fiber—10% polyethylene—80% cotton were conditioned by maintaining the specimens in a conditioning room maintained at 70 degrees±5 degrees F temperature and 50%±5% relative humidity for 24 hours preceding the test.

Each specimen was supported vertically and exposed to a Bunsen or Turill burner with a nominal I.D. tube adjusted to give a flame of 1½ inches (3.81 cm) in height by a calibrated thermocouple pyrometer in the center of the flame was 1550 degrees F. The lower edge of the specimen was ¾ inch (1.91 cm) above the top edge of the burner. The flame was applied to the center line of the lower edge of the specimens for 12 seconds and then removed.

Pursuant to the test, the material was self-extinguishing. The average burn length did not exceed 8 inches (20.32 cm). The average after flame did not exceed 15 seconds and there were no flame drippings.

Similar results may be achieved if the carbonaceous fiber is either derived from an acrylic precursor or a pitch based fiber.

What is claimed is:

1. A method of improving the flame retarding and fire blocking characteristics of a fiber tow or yarn of synthetic or natural fibers which comprises intimately blending into said tow or yarn at least 7.5% of heat set non-linear carbonaceous fibers having a carbon content of at least 65%, a nitrogen content between 5 and 35%, a LOI value greater than 40 and a reversible deflection of greater than 1.2:1 and an aspect ratio greater than 10:1.

2. The method of claim 1, wherein said fibers are non-linear.

3. The method of claim 1 wherein said carbonaceous fiber are derived from stabilized acrylic fibers.

4. The method of claim 1 comprising carbonaceous fibers having a nitrogen content of about 18 to about 20%.

5. The method of claim 4 wherein said carbonaceous fibers comprise at least 17% of said blend.

6. The method of claim 1 wherein said natural fibers are selected from the group consisting of cotton, wool, flax and silk.

7. The method of claim 1 wherein said synthetic fibers are selected from the group consisting of cellulosic, polyester, polyolefin, aramid, polyacrylic, fluoroplastic, polyamide and polyvinyl alcohol.

* * * * *